United States Patent [19]

Reagan

[11] 4,387,768

[45] Jun. 14, 1983

[54] MODIFIED IN SITU RETORTING OF OIL SHALE

[75] Inventor: John J. Reagan, Parma, Ohio

[73] Assignee: The Standard Oil Company, Cleveland, Ohio

[21] Appl. No.: 253,987

[22] Filed: Apr. 13, 1981

[51] Int. Cl.[3] ..... E21B 43/243; E21B 43/263

[52] U.S. Cl. ..... 166/256; 166/50; 299/2

[58] Field of Search ..... 166/259, 256, 50; 299/2, 11, 13, 19

[56] References Cited

U.S. PATENT DOCUMENTS

| | | | |
|---|---|---|---|
| 3,273,640 | 9/1966 | Huntington | 166/266 |
| 3,291,215 | 12/1966 | Nichols | 166/299 X |
| 3,437,378 | 4/1969 | Smith | 166/259 X |
| 3,454,958 | 7/1969 | Parker | 166/303 |
| 3,593,789 | 7/1971 | Prats | 166/259 |
| 4,059,308 | 11/1977 | Pearson et al. | 166/303 X |
| 4,118,070 | 10/1978 | French et al. | 166/259 X |
| 4,118,071 | 10/1978 | Hutchins | 166/259 X |
| 4,147,388 | 4/1979 | French | 166/259 X |

*Primary Examiner*—Stephen J. Novosad

*Attorney, Agent, or Firm*—John E. Miller; Herbert D. Knudsen; Larry W. Evans

[57] ABSTRACT

Rubblized oil shale beds to be processed by the modified in situ retorting technique are U-shaped so that the inlet end and outlet end of the bed communicate with a common channel.

8 Claims, 1 Drawing Figure

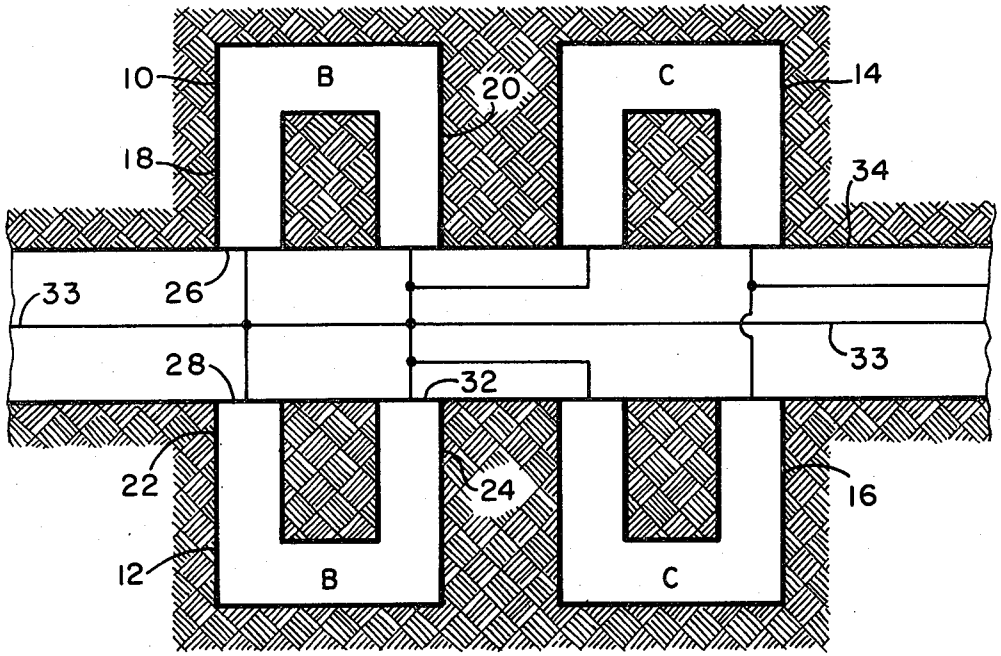
10
18
14
34
20
C
B
26
33
32
28
33
16
24
C
B
22
12

MODIFIED IN SITU RETORTING OF OIL SHALE

BACKGROUND OF THE INVENTION

Commonly assigned application Ser. No. 220,645, filed Dec. 29, 1980, the disclosure of which is incorporated herein by reference, describes a novel technique for the modified in situ retorting of oil shale wherein rubblized beds of oil shale are separately subjected to pyrolysis and combustion. Process gases are supplied to and product gases are withdrawn from each bed, in both the combustion and pyrolysis modes, by a pressure pulsing operation.

In order to carry out the process economically in large horizontal beds or retorts, the beds are arranged in associated pairs and processed oppositely. In other words, while one bed undergoes compression, the other bed in the pair undergoes a corresponding decompression. By this means, pressure pulsing of both beds in the pair can be accomplished using only a single compressor operating full time.

A major cost of the process described in the above-noted Ser. No. 220,645 is due to the extensive mining necessary to form inlet and outlet channels for each bed and the additional lengths of piping required in these channels to carry the product and process gases.

Accordingly, it is an object of the present invention to provide a new bed configuration which will allow significant reduction in the size, length and complexity of inlet and outlet channels and piping needed for carrying out the modified in situ process described in the above-noted application.

SUMMARY OF THE INVENTION

This and other objects are accomplished by the present invention in accordance with which rubblized shale beds to be subjected to modified in situ retorting such as, for example, by the process described in the above-identified application are U-shaped. Each bed in an associated pair of beds is arranged so that the legs of the beds point at one another whereby the inlet and outlet ends of each bed face one another. In this configuration, the inlet and outlet ends of both beds can communicate with a single drift or adit thereby necessitating the mining of only a single drift or adit rather than a plurality of drifts or adits as required by other designs.

Thus, the present invention provides an improvement in the known process for the in situ recovery of shale oil from an oil shale formation in which a first gas is charged into a rubblized bed in the formation and a second gas is removed from said bed, the improvement in accordance with the invention wherein said bed is U-shaped.

BRIEF DESCRIPTION OF THE DRAWINGS

The sole FIGURE is a schematic plan view of four associated rubblized oil shale beds arranged in two pairs, each bed being U-shaped in accordance with the present invention.

DETAILED DESCRIPTION

Referring to the FIGURE, four rubblized oil shale beds 10, 12, 14 and 16 are shown arranged in two pairs, pair B and pair C. Beds 10 and 12 are an associated pair of spent shale beds which have been previously pyrolyzed and at least partially combusted. Beds 14 and 16 are a pair of associated raw oil shale beds which are to be pyrolyzed using the latent heat in beds 10 and 12, as more fully described in the above-noted application Ser. No. 220,645.

In accordance with the invention, each of beds 10, 12, 14, and 16 is U-shaped in plan and arranged so that the individual legs of each bed point at one another. For example, legs 18 and 20 of bed 10 point directly at legs 22 and 24 of associated bed 12. By this means, inlets 26 and 28 of beds 10 and 12, respectively, face one another and similarly outlets 30 and 32 of beds 10 and 12, respectively, also face one another. In addition, each of these inlets and outlets as well as all of the inlets and outlets in beds 14 and 16 communicate with single common channel 34. Thus, connection of all of the inlets and outlets of each of the beds to one another by internal piping 33 and to external piping is facilitated since all of the connections can be made in a single common channel.

Although only a single embodiment of the invention has been illustrated above, it should be appreciated that many modifications can be made without departing from the spirit and scope of the invention. For example, larger rubblized beds can be made by conventional room and pillar techniques in which case rubblization of the beds would be accomplished so that pillars of suitable size and spacing would be left in the interior of the rubblized U-shaped beds of the invention. Also, in beds of comparatively large vertical height, for example 100 feet, the inlets and/or outlets of the respective beds can be at different vertical levels. For example, inlets at or near the upper end of the beds and outlets at or near the lower end of the beds could be employed. In such instances, two channels, one for the inlets and the other for the outlets, would be needed. However, even in this instance mining costs are significantly reduced because the inlets and outlets of associated beds are in close proximity. All such modifications are intended to be included within the scope of the present invention, which is to be limited only by the following claims:

I claim:

1. In a process for the in situ recovery of shale oil from an oil shale formation in which a first gas is charged into a rubblized bed in said formation and a second gas is removed from said bed, the improvement wherein said bed is U-shaped and defines an inlet leg and an outlet leg, said inlet and outlet legs communicating with a common channel in said formation.

2. The process of claim 1 wherein a plurality of U-shaped beds are arranged in pairs, the beds in each pair being arranged on opposite sides of said channel.

3. The process of claim 2 wherein the beds in each pair are arranged so that the gas inlet legs of each pair face one another and the gas outlet legs of each pair face one another.

4. In a process for the in situ recovery of shale oil in which at least one pair of associated rubblized shale beds in a shale formation are pyrolyzed by contact with a hot retorting gas, said hot retorting gas being supplied to said beds in a pressure pulsing mode whereby the gas pressure in said beds varies between higher and lower pressures, one of the beds in said pair undergoing compression while the other bed in said pair undergoes decompression, the improvement wherein each of said beds is U-shaped and defines an inlet leg and an outlet leg, the inlet leg of each bed in said pair facing one another and the outlet legs in each bed in said pair facing one another.

5. The process of claim 4 wherein said inlet legs and said outlet legs communicate with a common channel in between the beds in said pair.

6. In a process for the in situ recovery of shale oil from a plurality of rubblized oil shale beds in an oil shale formation in which a first gas is charged into said beds and a second gas is removed from said beds, the improvement wherein said rubblized oil shale beds are U-shaped, each U-shaped bed defining an inlet leg for receiving said first gas and an outlet leg for discharging said second gas, the inlet legs of said U-shaped beds communicating with a common channel and the outleg legs of said U-shaped beds communicating with a common channel.

7. The process of claim 6 wherein said inlet legs communicate with a first common channel and said outlet legs communicate with a second common channel.

8. The process of claim 7 wherein said plurality of rubblized oil shale beds are arranged in associated pairs, said first channel and said second channel being arranged between the members of said associated pairs.

* * * * *